United States Patent [19]

Chantler et al.

[11] 4,147,231

[45] Apr. 3, 1979

[54] LADDER STABILIZING DEVICE

[76] Inventors: Douglas A. Chantler, 33 Magwood Ct., Toronto, Ontario, Canada, M6S 2M4; Ross W. Coleman, 5 Groomsport Crescent, Agincourt, Ontario, Canada

[21] Appl. No.: 836,914

[22] Filed: Sep. 26, 1977

[30] Foreign Application Priority Data

Sep. 27, 1976 [CA] Canada ..... 262111

[51] Int. Cl.[2] ..... E06C 1/16; E06C 5/36

[52] U.S. Cl. ..... 182/172; 182/107

[58] Field of Search ..... 182/172, 204, 205, 107, 182/108

[56] References Cited

U.S. PATENT DOCUMENTS

| | | | |
|---|---|---|---|
| 1,151,809 | 8/1915 | Morgan | 182/172 |
| 1,385,319 | 7/1921 | Enke | 182/172 |

*Primary Examiner*—Reinaldo P. Machado

*Attorney, Agent, or Firm*—Ridout & Maybee

[57] ABSTRACT

A stablizing device to be connected on the outer sides of the side pieces of a ladder has a lower leg pivoted on a lower part of the side piece and pivoted at its upper end to an upper leg part which has a locking member for releasable locking on the side piece. By adjustment of the upper leg part, the leg parts can be braced against the ground or against a vertical wall surface. This device leaves the rungs of the ladder unobstructed and the upper leg part may be freely slidingly connected on the side piece so that the knees can readily be adjusted independently to allow the ladder to be stabilized on uneven ground. There is disclosed an arrangement in which a lever on the upper leg part engages a toothed rack on the side piece and lifts the ladder bodily upwards a small distance as the lever is pressed inward to the side of the ladder. This lifting action transfers the weight of the ladder from the foot of the ladder to the outlying feet of the upper leg parts so that a wide and stable supporting base is provided.

12 Claims, 16 Drawing Figures

FIG. 7
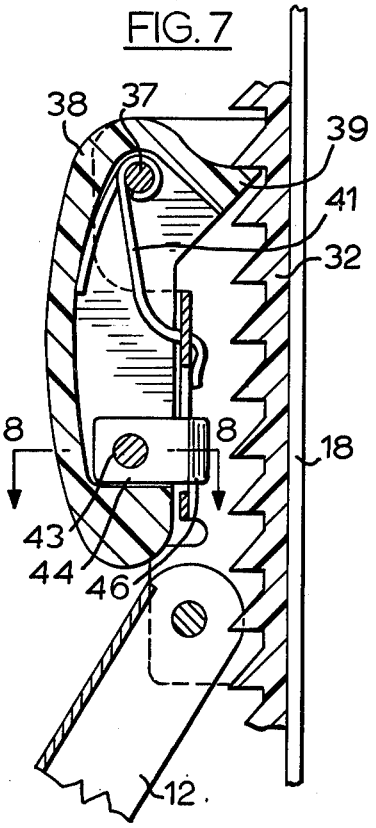
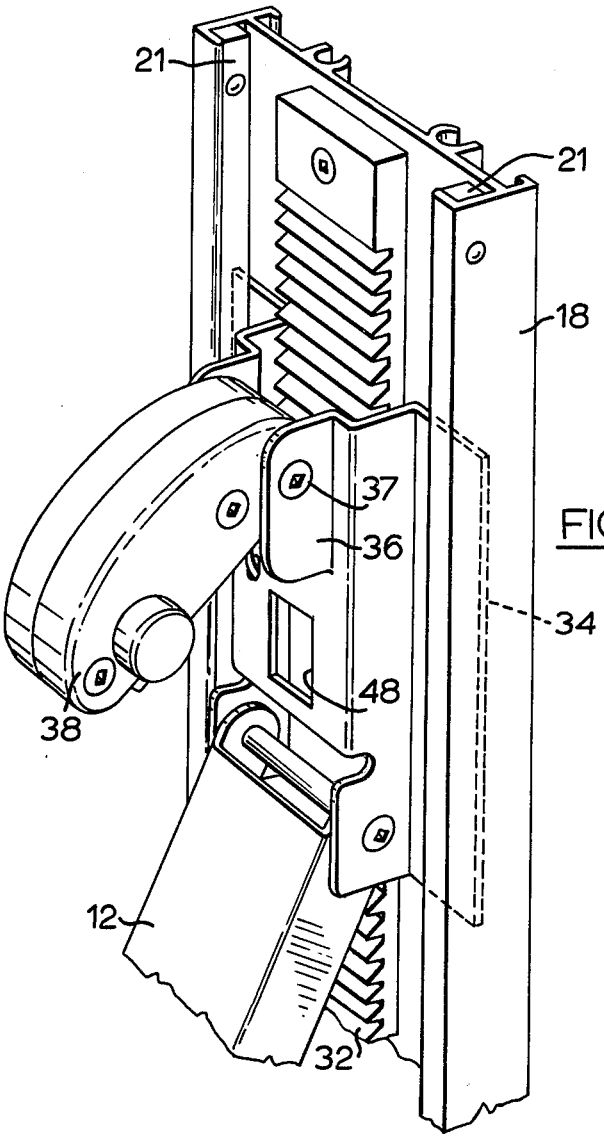
FIG. 6
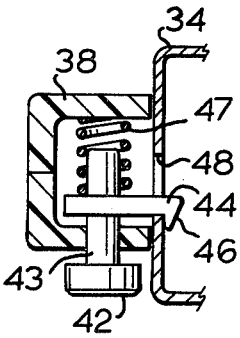
FIG. 8
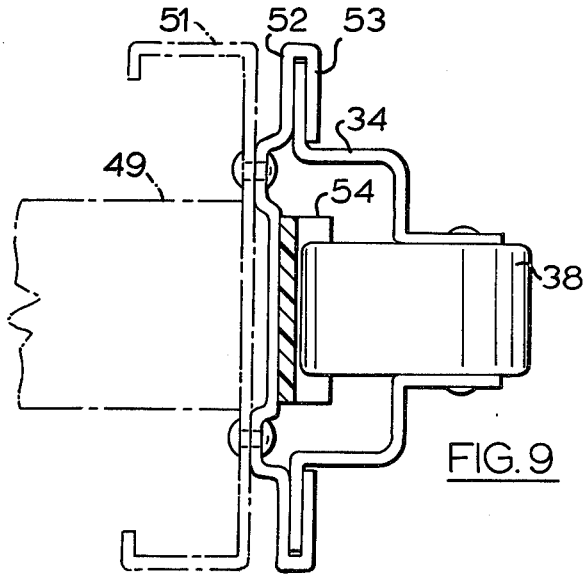
FIG. 9

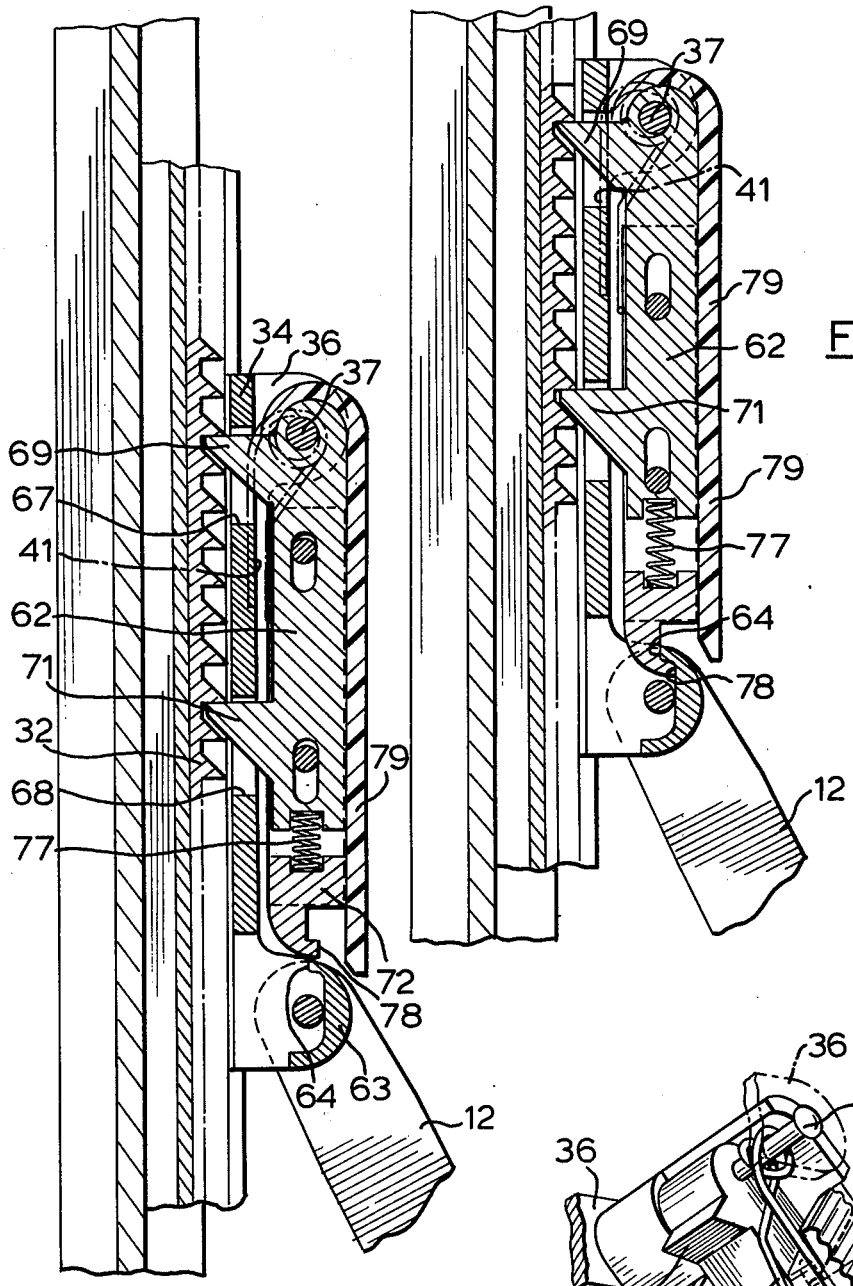
FIG. 14
FIG. 13
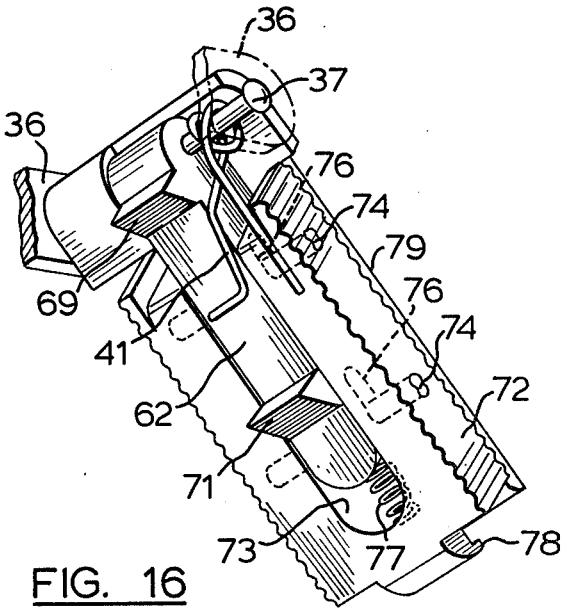
FIG. 16

LADDER STABILIZING DEVICE

BACKGROUND OF THE INVENTION

It has been proposed to provide the lower end of a ladder with stabilizing members which provide a more stable base for the ladder. The prior proposals of which the inventor is aware have, however, obstructed the lower rungs of the ladder or have otherwise been cumbersome and inconvenient, and do not provide much stability if the foot of the ladder is on uneven ground.

SUMMARY OF THE INVENTION

In this invention, stabilizing means are provided for connection on each side piece of a ladder on its outer side and comprising upper and lower leg parts which are pivoted together at a knee. The lower leg part is to be pivotally connected on the outside of the side piece and the upper leg part has a locking member for engagement with the side piece. This locking member can be releasably retained on the side piece at an upper position and at a range of lower positions.

Using this arrangement, the rungs of the ladder are unobstructed. At the upper, or storage position of the locking member, the leg parts lie compactly flat along the ladder side pieces and at the lower positions of the locking member, the leg parts are mutually inclined outwardly from the side pieces so that the knees can be engaged on surrounding surfaces. The heights and positions of the two knees on opposite sides of the ladder can be adjusted independently, so that they can be used on uneven surfaces, while it is also possible to have one knee bracing on the ground and the other engaging a wall or other adjacent vertical surface.

The invention also provides an arrangement in which there is a reaction means e.g. a toothed rack on the side piece of the ladder, and the upper leg part has a lever means, e.g. a pivoting dog, which reacts with the reaction means. When the lever means is pivoted inward, it engages the reaction means and lifts this upwardly with the result that the ladder, to which the reaction means is attached, is lifted bodily upwards. This lifting action lifts the foot of the ladder off the ground by a small distance and serves to transfer the weight of the ladder from the foot to the outlying leg parts. Thus a wider and hence more stable base for the ladder is provided.

In the accompanying drawings there are shown examples of stabilizing means which may be sold as a kit and are adapted to be fitted to existing types of ladders. The stabilizing means may, however, instead be provided on the ladder in in-shop fitting by the ladder manufacturer.

BRIEF DESCRIPTION OF THE DRAWINGS

FIG. 6 shows in perspective a further form of stabilizing means in which a lifting action is achieved;

FIG. 7 is a vertical section through the device of FIG. 6;

FIG. 8 is a section on the line 8—8 of FIG. 7 illustrating a catch for the locking device;

FIG. 9 illustrates an alternative form applicable for ladders having other types of side pieces;

FIGS. 11 to 14 each show a vertical section through the stabilizing means employed on the ladder of FIG. 10, the successive Figures illustrating in sequence the operation of closing the lever means and exerting the lifting action;

FIG. 16 is a more detailed view in perspective of the lever means and its associated catch member.

DESCRIPTION OF THE PREFERRED EMBODIMENTS

Figures 1, 2, 3:
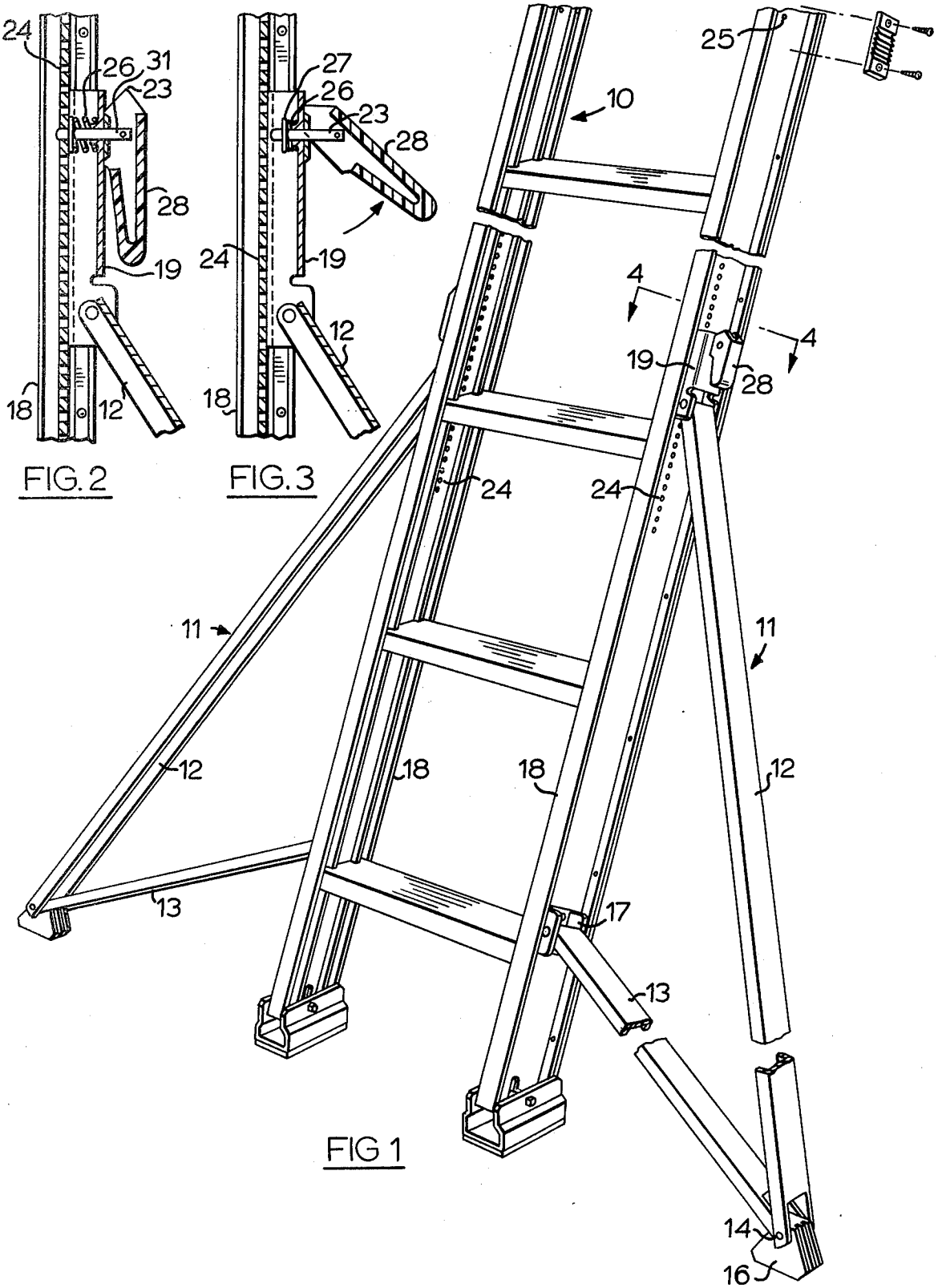
FIG. 1 shows in perspective a ladder equipped with one form of stabilizing means.
FIGS. 2 and 3 are vertical sections through the ladder side pieces illustrating the action of the locking means.

Referring to the drawings wherein like reference numerals indicate like parts, FIGS. 1 to 8 show one conventional form of ladder 10.

As illustrated, the ladder 10 is modified by using stabilizing devices comprising outwardly extensible legs 11. These comprise upper and lower channel-section metal leg parts 12 and 13 which are pivotally connected together at a pin 14, forming a knee, on a frictional, robust, surfacing-engaging knee pad 16, which may be of hard rubber, pivots on the lower end of the upper leg part 12, on the pin 14.

The lower, shorter, leg 13 pivots on a support plate 17 riveted on the side piece 18 of the ladder. The upper end of the upper longer, leg part 12 is pivotally connected to a slider plate 19. As can best be seen in FIG. 4, the outer side of the side piece 18 is of channel section. A pair of insert strips 21 are riveted on the inner sides of the channel and their inner edges define with the bottom of the channel a pair of tracks 22 in which the side flanges of the slider plate 19 run. The strips 21 provide a track for the sliding plate 19 extending from the upper storage position as shown in FIG. 5 to a lower support position above the lower support plate 17.

Figure 5:
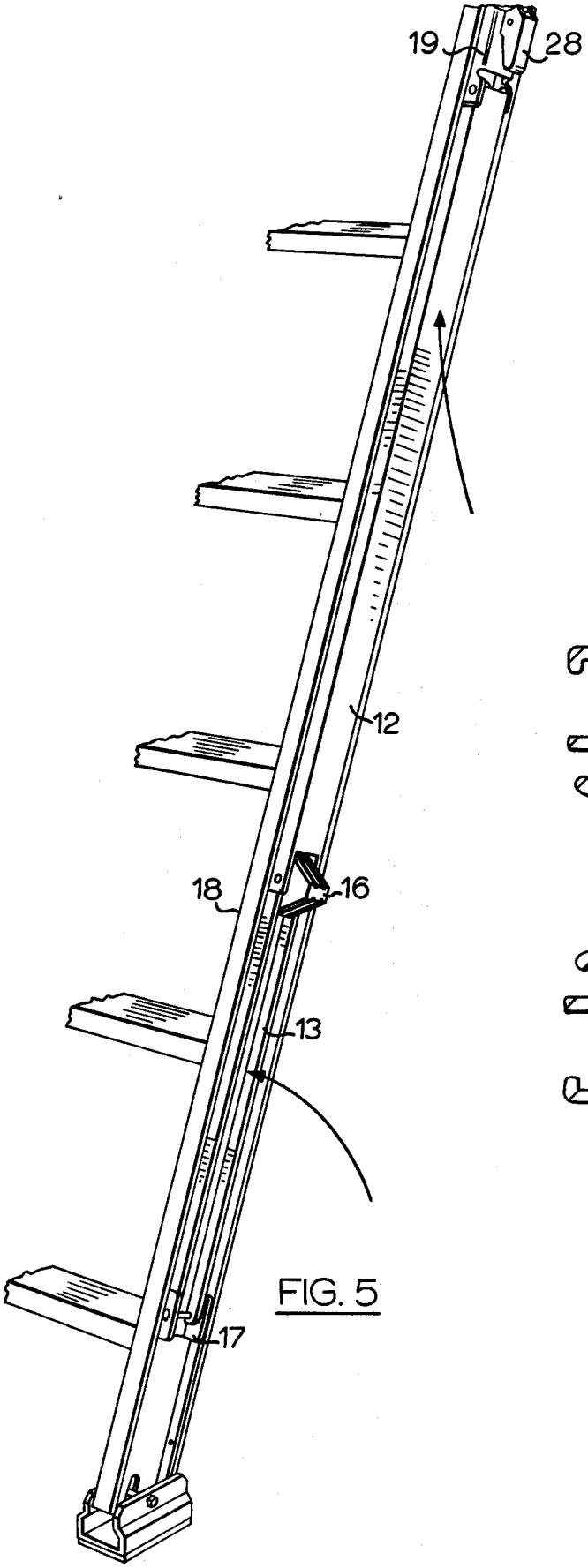
FIG. 5 shows the stabilizing means in the storage position.
Figure 4:
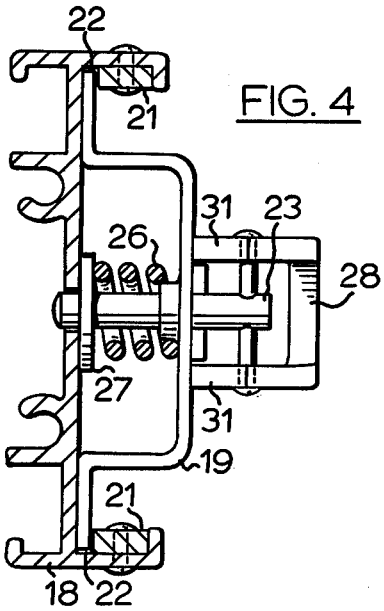
FIG. 4 is a horizontal section through the locking means on the line 4—4 of FIG. 1.
Figure 10:
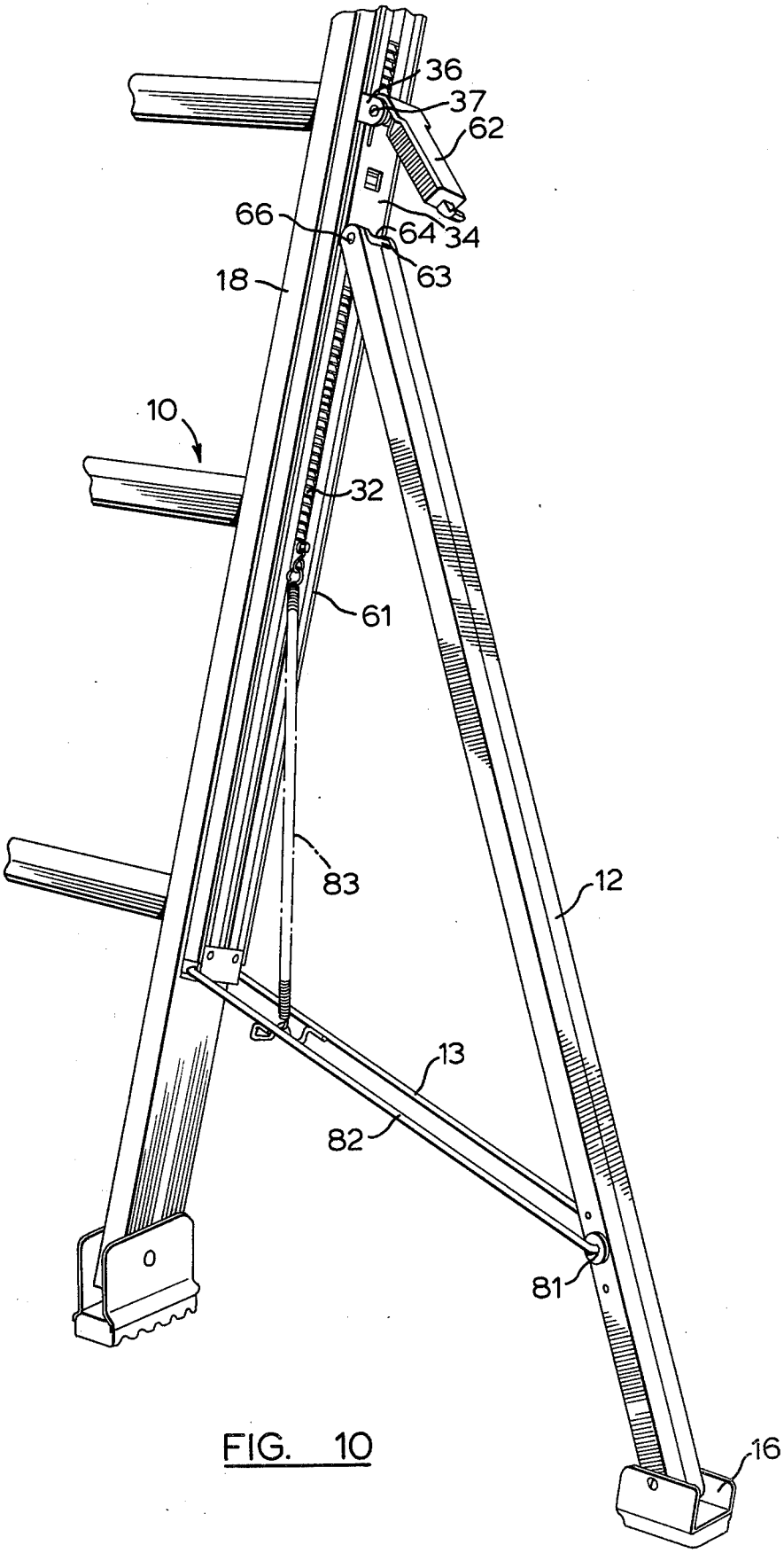
FIG. 10 shows in perspective one side of a ladder equipped with a further form of stabilizing means which achieves a lifting action.

With this arrangement, the position of the slider plate 19 can be varied between the storage position, as shown in FIG. 5, in which the leg parts 12 and 13 lie flat along the side piece 18 and are partly received in the channel of the side piece, and a range of lower stabilizing positions one of which is shown in FIG. 1. Where the ground surface is uneven, the slider plate may be brought to lower positions closer to the plate 17, or to higher positions, enabling the pad 16 at the knee to bracingly, engage on the ground surface or an adjacent wall surface.

The plate 19 is provided with a locking member for locking it in position on the side piece 18, the locking member in the forms shown in FIGS. 1 to 5 including a pin 23 which can be inserted into an array of holes 24 formed at desired heights in the side pieces 18.

The extent of the array of holes 24 is such that the knee pad 16 can be held at a range of positions from somewhat below the level of the foot of the ladder to higher positions approaching the storage position of FIG. 5.

A hole 25 is provided at the upper limit of travel of the plate 19 to allow it to be anchored in the storage position.

The pin 23 is biased inwardly away from the plate by a spring 26 acting on a collar 27 on the pin. The locking position is shown in FIG. 2. To allow the pin to be held in the retracted position when it is desired to slide the plate 19 along the side piece 18 the pin is pivotally connected to a hollow lever 28 through an internal transverse pin 29.

The sides of the lever 28 are formed with inclined camming surfaces 31 at their inner ends. As shown in FIG. 3, the lever 28 can be rocked outwardly against the action of the spring 26 to hold the pin 23 in the retracted position temporarily through the reaction between the camming surfaces 31 and the plate 19.

The arrangement of FIGS. 6 to 8 differs in the forms of slider plate and locking member that are used. Instead of using an array of holes such as the holes 24, a toothed rack 32 is connected on the outer side of each side piece 18. The rack extends along the side piece 18 over the portion of the side piece's length on which it is desired to retain the slider plate in the lower stabilizing positions, i.e. normally the same extent as the extent of the array of holes 24.

The slider plate 34 which is used, as shown in FIG. 6 has a pair of upstanding lugs 36 between which extends a pivot pin 37. A hollow lever 38 is pivoted on the pin 37 and is formed on the inner side of its upper end with an inwardly-projecting dog 39.

In use, the lever 38 can be swung inwardly from the released position shown in FIG. 6 in which the dog 39 is clear of the teeth of the rack 32 to the inner, locked position shown in FIG. 7 where the dog 39 engages on the underside of an adjacent tooth of the rack. It is most important to note that with this arrangement as the lever 38 is swung inwardly, the leading edge of the dog 39 engages on the underside of a rack tooth and as the lever 38 is finally moved to its locked position, the dog bodily lifts the tooth, the rack 32, and the ladder to which the rack 32 is attached, relative to the legs 12 and 13 and to the knee 16 which rests solidly on the ground. The effect of raising the ladder bodily by some small distance, which need be no more than about one-quarter of an inch, is to transfer the weight of the ladder from the foot of the ladder to the outlying knee pads 16, so that the weight-supporting base of the ladder is made much wider and the ladder is effectively stabilized.

The lever 38 is fitted internally with a spring 41 acting between the plate 34 and the inner surface of the lever, so as to normally hold the lever in the outer, released position permitting free movement of the plate. A catch is provided for holding the lever 38 in the inner locked position. As best shown in FIG. 8 the catch comprises a button 42 connected on a stem 43 sliding in a hole in the side of the lever 38. The stem 43 has a tab 44 with a lip 46 biased outwardly by a spring 47. The lip 46 is formed with a bevelled leading edge and as the lever is swung inwardly, the bevelled edge engages a side of a slot 48 in the plate 34 and deflects the tab 44 against the action of the spring 47 to permit the lip 46 to engage behind the side of the slot 48 as shown in FIG. 3. The lever 38 can be released by depressing the button 42 so as to free the lip 46, whereupon the lever is swung outwardly by the action of its internal spring 41.

A small section of toothed rack (indicated at 49 in FIG. 1) may be attached on the upper part of the side piece 18 to serve as an anchorage for the slider plate 34 at the upper, storage position. This small section 49 may be of soft, yielding rubber so as to absorb the leverage exerted by the dog 39.

Where the external profile of the ladder does not readily lend itself to forming a sliding track for the upper end of the upper leg part, a fitting may be attached on the ladder side pieces so as to provide a sliding track. An example of such a fitting is shown in FIG. 9, where a rung 49 and a side piece 51 of a ladder are shown in broken lines. A sliding track 52, formed as an extruded section, is riveted on the side piece 51 and includes inturned edge parts 53 which slidingly confine a slider plate 34 of the form shown in FIG. 6, having a lever 38 as the locking member. The central part 54 of the track can serve to support the toothed rack 32 with which the lever 38 engages.

In the embodiment shown in FIGS. 10 to 16, an extruded metal track 61 is attached, for example by screws, on each side piece 18. The track 61 slidingly receives and retains the slider plate 34 and carries the toothed rack 32. The upper end of the slider plate 34 has the raised lugs 36 on which a lever 62 is pivoted about the pin 37. The lower end of the slider plate 34 is formed integrally with a hollow transversely extending bridge 63 in the upper surface of which is a recess 64. The upper leg part 12 pivots on a pin 66 passing through the bridge 63.

The slider plate 34 is formed with upper and lower apertures 67 and 68 through which, when the lever 62 is in closed position, upper and lower dogs 69 and 71 extend which are formed integrally with the lever 62.

A catch member 72 is movably connected on the lever 62. As best shown in FIG. 16, the catch member has a central longitudinal slot 73 which receives the lever 62, and is movably retained on the lever by dowel pins 74 which pass through elongated slots 76 through the lever, so that the catch member 72 can be reciprocated relative to the lever 62. A compression spring 77 between the lever 62 and the member 72 urges the catch member downwardly. The lower end of the catch member 62 has an outwardly turned lip 78. In the embodiment shown, the lever 62 is connected to a plastics cover plate 79 on the underside of which the upper surface of the catch member 72 reciprocates, but preferably the cover plate 79 is formed integrally with the lever 62.

In use, as with the previously described embodiments, the slider plate 34 is first slid downwardly from the upper storage position so that the upper and lower leg parts 12 and 13 on either side of the ladder are spread apart until each rubber knee pad 16 engages firmly on the ground.

Figure 11:
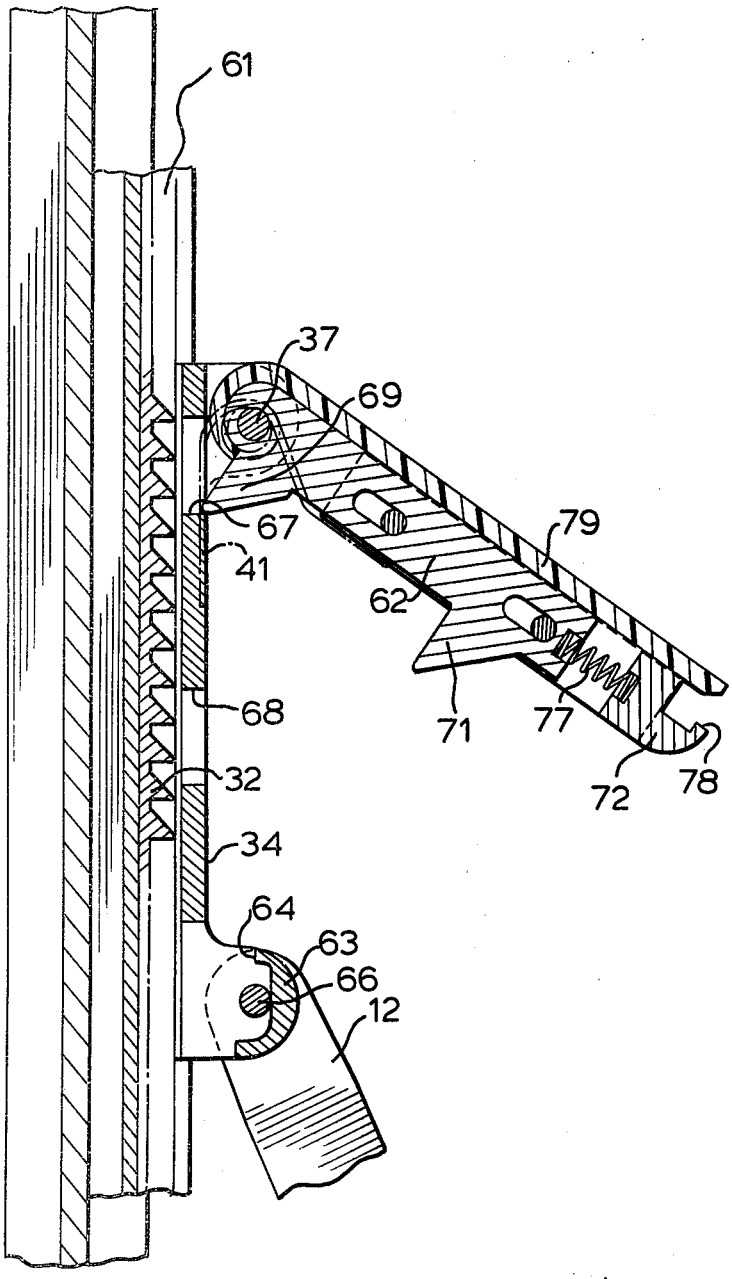
Figure 12:
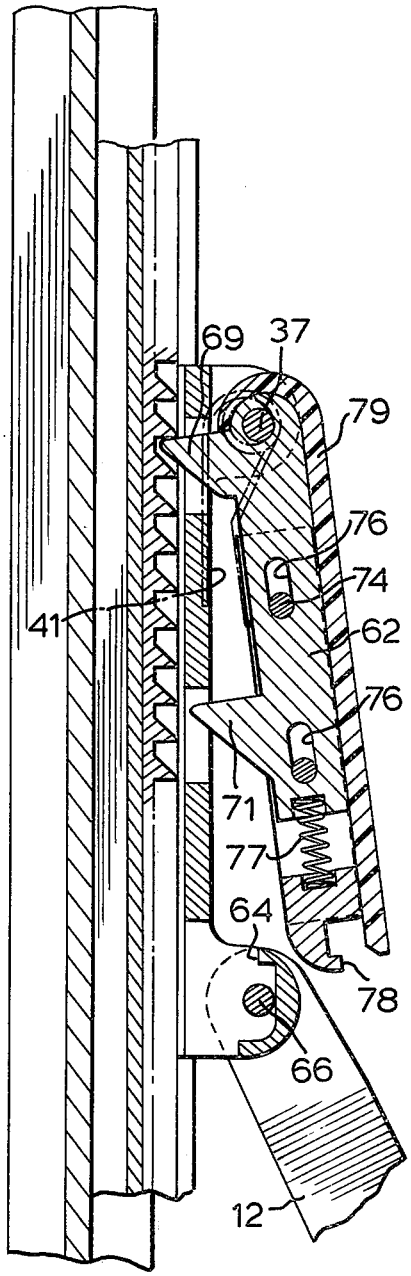

The lever member 62 is then pressed inwardly as shown in FIGS. 11 and 12, and the upper dog 69 engages a tooth of the rack 32 and the levering action lifts the rack upwardly together with the ladder to which the rack is attached.

Figure 15:
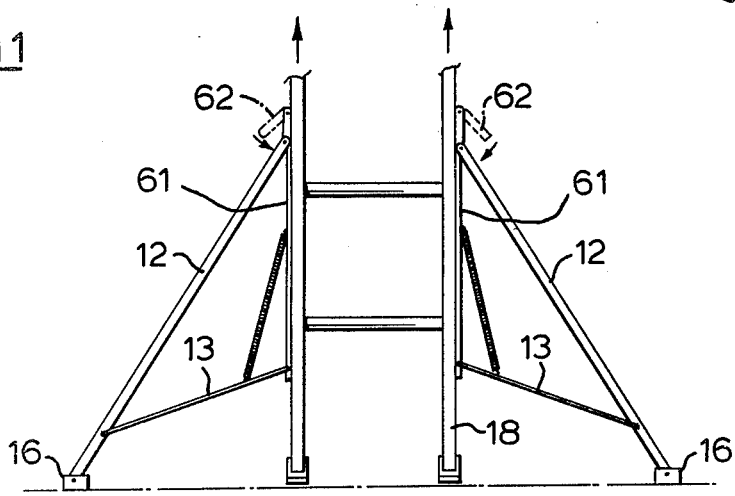
FIG. 15 is a view of the ladder from the front illustrating the lifting action.

The lifting action is illustrated in FIG. 15, where the movement of the levers 62 inwardly from the position shown in broken lines causes the foot of the ladder 18 to be lifted a small distance clear of the ground, so that the weight of the ladder is transferred to the outlying knee pads 16. The extent of upward lifting need not be large and typically may be about one-quarter of an inch. A satisfactory stabilization is achieved with this lifting action.

As the lever 62 is pressed inwardly, the lower edge of the catch member 72 engages the rounded surface of the bridge 63 as shown in FIG. 13 and the catch member is pressed upwardly against the action of the spring 77 until the lever is pressed inwardly sufficiently for the lip 78 to clear the edge of the recess 64 in the bridge 63. The catch member 72 then snaps downward under the action of the spring 77. On release of the lever 62, the spring 41 between the lever 62 and the slider plate 34 presses the lever 62 outwards so that the lip 78 is held pressed into positive engagement with the recess 64, preventing outward movement of the lever 62.

As shown in FIGS. 13 and 14, at the inward position of the lever 62 the rack 32 is engaged by the second, lower dog 71 as well as by the upper dog 69, so that movement of the slider plate 34 relative to the rack 32 and track 61 is prevented.

As a safeguard against accidental dislodgement of the lever 62, it will be noted that in order to free the lip 78 from the recess 64, it is necessary to simultaneously press the lever 62 inwards and grasp the catch member 72 between the fingers and slide it upwardly relative to the lever 62. Thus with this arrangement, the catch cannot be freed by an accidental blow striking the mechanism.

The lower leg part 13 is pivotally connected to the upper leg part 12 at a point 81 intermediate the ends of the part 12. With this arrangement, the lower leg part is spaced upward from the ground and so can remain clear of the ground surface if the leg 12 needs to be extended across a step, and the length of the track 61 can be made somewhat shorter, since the extent of upward movement of the slider plate 34 to the storage position is thereby reduced, as compared with the embodiments of FIGS. 1 to 9, for the same extent of outward spreading of the leg part 12.

Instead of using channel-section metal for the lower leg part 13, this part, which need only withstand forces in tension, is fashioned from sturdy metal rod material 82.

A tension spring 83 is connected between the lower leg part 13 and the track 61 and tends to urge the lower leg part 13 together with the upper leg part upwardly. The spring 83 acts as a counterweight and slows the downward movement of the leg part 12 when this is moved from its upper storage position.

I claim:

1. Stabilizing means for connection on the outer side of each side piece of a ladder comprising a lower leg part adapted to be pivotally connected on the side piece, an upper leg part pivotally connected to the lower leg part, a reaction member for connection on the side piece above the lower leg part, rotatable means connected to the upper leg part and having an axis of rotation, said rotatable means rotating in engagement with the reaction member to shift the reaction member upwardly relative to the axis of rotation and the upper leg part, and releasable retaining means for retaining the rotatable means in fixed position relative to the reaction member.

2. Stabilizing means for connection on the outer side of each side piece of a ladder comprising a lower leg part adapted to be pivotally connected on the side piece, an upper leg part pivotally connected to the lower leg part, a reaction member for connection on the side piece above the lower leg part, lever means pivotally connected to the upper leg part and moving in engagement with the reaction member to shift the reaction member upwardly relative to the lever means and upper leg part, and releasable retaining means for retaining the lever means in fixed position relative to the reaction member.

3. Stabilizing means according to claim 2 wherein said reaction means comprises a toothed rack adapted to be connected longitudinally on the side piece and the lever means comprise a pivotal dog for engagement with the rack, the dog reacting against a tooth of the rack and urging the rack upwardly relative as the dog is pivoted into engagement with the rack, and wherein said releasable retaining means retain said dog in engagement with said tooth.

4. Stabilizing means according to claim 3 including a spring biasing the dog outwardly and wherein said releasable retaining means is operable to hold the lever against the spring action in the inner position with the dog in engagement with the rack.

5. Stabilizing means according to claim 2 including a track for connection longitudinally on the side piece and a slider pivotally connected on the upper leg part and sliding on the track, and wherein said lever means are pivoted on the slider.

6. Stabilizing means according to claim 5 wherein the slider is slidingly confined by the track.

7. Stabilizing means according to claim 2 wherein the releasable retaining means comprise a catch member which is released by simultaneously lifting it and pushing it inwardly toward the side piece.

8. Stabilizing means according to claim 7 wherein the catch member pivots with the lever means and has a projecting lip engageable on a catch recess when the catch member is pivoted inwardly, and including a spring biasing the catch member downwardly toward the catch recess.

9. Stabilizing means according to claim 2 wherein the lower leg part is pivotally connected intermediate the ends of the upper leg part.

10. Stabilizing means according to claim 2 including spring means tending to urge the lower and upper leg parts upward.

11. Stabilizing means according to claim 10 wherein the spring means acts between the reaction member and the lower leg part.

12. A ladder having independently operating stabilizing means as claimed in claim 3 connected on the outer side of each side piece.

* * * * *